US008070078B2

(12) United States Patent
Bearman et al.

(10) Patent No.: US 8,070,078 B2
(45) Date of Patent: Dec. 6, 2011

(54) CRUSHING MATERIAL

(75) Inventors: Richard Anthony Bearman, Attadale (AU); Robin John Batterham, Parkville (AU); Raymond Walter Shaw, Carlton North (AU)

(73) Assignee: Technological Resources Pty Limited, Melbourne, Victoria (AU)

( * ) Notice: Subject to any disclaimer, the term of this patent is extended or adjusted under 35 U.S.C. 154(b) by 552 days.

(21) Appl. No.: 11/666,023

(22) PCT Filed: Oct. 24, 2005

(86) PCT No.: PCT/AU2005/001645

§ 371 (c)(1),
(2), (4) Date: Apr. 11, 2008

(87) PCT Pub. No.: WO2006/042378

PCT Pub. Date: Apr. 27, 2006

(65) Prior Publication Data

US 2008/0257992 A1 Oct. 23, 2008

(30) Foreign Application Priority Data

Oct. 22, 2004 (AU) ..... 2004906136
Nov. 29, 2004 (AU) ..... 2004906815

(51) Int. Cl.
*B02C 4/28* (2006.01)

(52) U.S. Cl. ..... 241/1; 241/29; 241/152.2; 241/159; 241/301

(58) Field of Classification Search ..... 241/1, 301, 241/29, 159, 152.2
See application file for complete search history.

(56) References Cited

U.S. PATENT DOCUMENTS

| | | | | |
|---|---|---|---|---|
| 2,158,321 | A * | 5/1939 | Brown | 241/159 |
| 2,622,855 | A * | 12/1952 | Kulp et al. | 366/134 |
| 4,655,400 | A | 4/1987 | Erb et al. | |
| 2003/0029944 | A1 * | 2/2003 | Flinn et al. | 241/1 |

FOREIGN PATENT DOCUMENTS

| | | |
|---|---|---|
| CA | 2 164 925 | 6/1997 |
| CA | 2 440 311 | 4/2005 |

* cited by examiner

*Primary Examiner* — Mark Rosenbaum
(74) *Attorney, Agent, or Firm* — The Webb Law Firm

(57) ABSTRACT

A method and an apparatus for crushing material, particularly mined material, are disclosed. In one embodiment two or more pairs of crushing rolls successively crush mined material. The pairs of crushing rolls are arranged and operated so that an upstream pair of rolls produces a feed, preferably a pressurized feed, for a downstream pair of rolls. In another embodiment, at least an upstream pair of rolls is driven intermittently, for example, by means of a stepping motor to provide stepped rotational movement of the rolls.

23 Claims, 1 Drawing Sheet

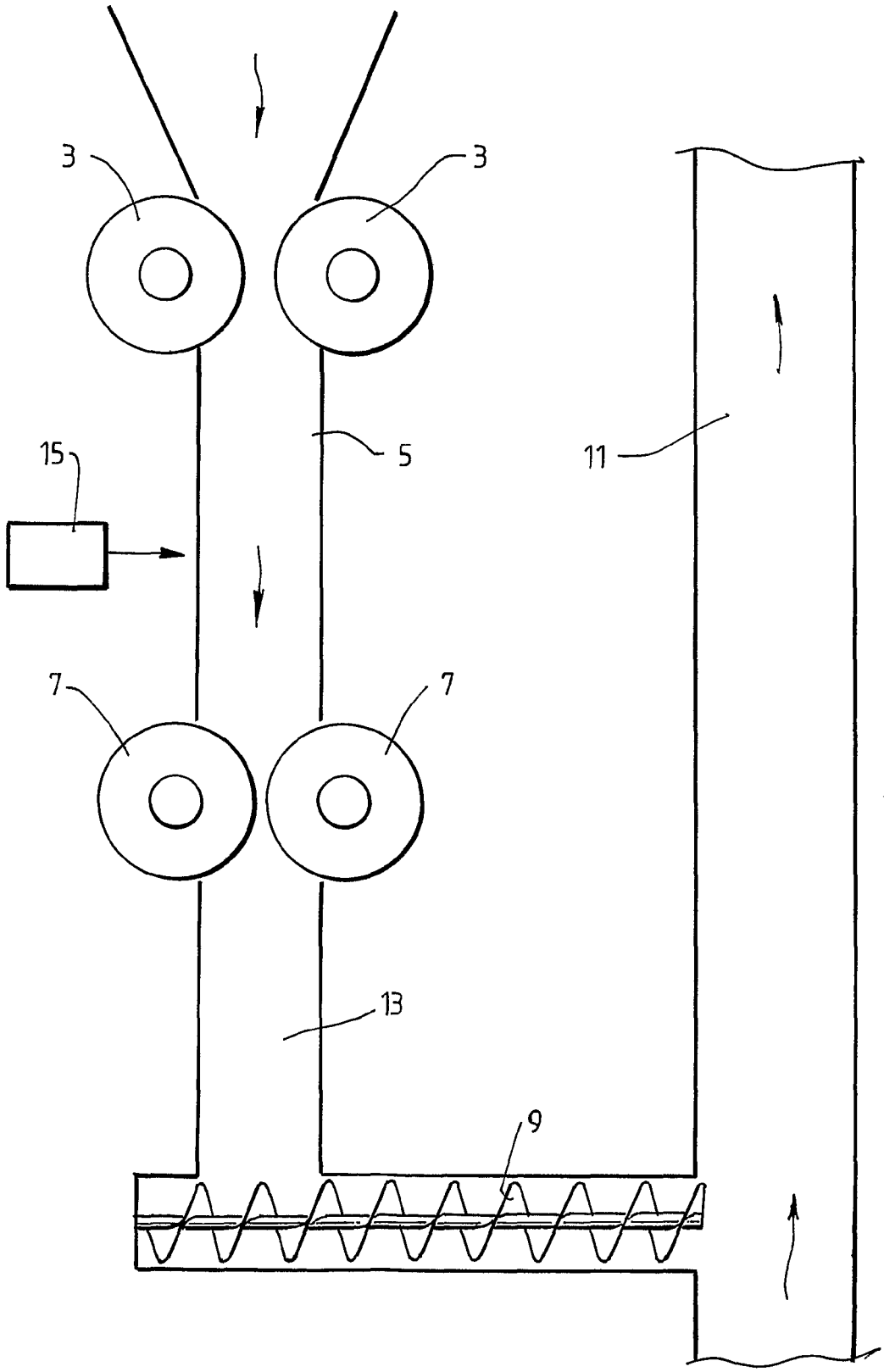
3
3
15
5
11
7
7
13
9

CRUSHING MATERIAL

The present invention relates to crushing material.

The material may be any material that requires size reduction.

By way of example, the material may be mined material. By way of further example, the material may be biomass material.

The following description of the invention focuses on crushing mined material. However, the present invention is not confined to this material.

The present invention relates particularly, although by no means exclusively, to crushing mined material and thereafter conveying the crushed material to another location for stockpiling and/or further processing the material.

The present invention relates more particularly, although by no means exclusively, to crushing mined material in situations in which there is limited working space where the material is mined and it is necessary to convey the mined material to a remote location for stockpiling and/or further processing the material, such as processing to recover valuable material from the mined material.

One such situation is in an underground mine, particularly an underground mine for metalliferous material where it is necessary to convey mined material to the surface for further processing of the material.

One aspect of the present invention is based on the use of two or more pairs of crushing rolls that successively crush mined material and are arranged and operated so that an upstream pair of rolls produces a feed, preferably a pressurised feed, for a downstream pair of rolls. Producing a feed, preferably a pressurised feed, for a downstream pair of rolls facilitates efficient crushing of mined material.

According to the first aspect of the present invention there is provided an apparatus for crushing material that includes an upstream pair of crushing rolls defining a nip therebetween for receiving feed material and crushing the feed material to a first particle size range and for forcing crushed material from the nip, a downstream pair of crushing rolls having a nip therebetween for receiving crushed material from the upstream pair of rolls and crushing the feed material further to a second particle size range, and a transfer chute extending between the upstream and downstream pairs of rolls, whereby in use of the apparatus, crushed material from the upstream pair of rolls forms a feed of material for the downstream pair of rolls as it moves through the transfer chute towards the downstream pair of rolls.

Preferably the apparatus is adapted to form a pressurised feed of crushed material moving through the transfer chute from the upstream pair of rolls to the downstream pair of rolls.

The crushed material from the upstream pair of rolls may move as a non-pressurised gravity feed to the downstream pair of rolls.

In use, the resultant crushed material from the downstream pair of rolls may be conveyed to a remote location for stockpiling and/or further processing the material or directly fed into a processing plant or otherwise handled as required in a given situation.

A second aspect of the present invention is based on the realisation that driving at least an upstream pair of rolls intermittently, for example by means of a stepping motor to provide stepped rotational movement of the rolls, provides considerable advantages.

One advantage is that intermittent, such as stepped, rotation roll operation allows gas to escape from the nip between rolls. Gas removal minimises the possibility of fluidising feed material in the nip. Consequently, it is possible to improve throughput of feed material.

Another advantage is that intermittent, such as stepped, rotation roll operation allows moisture to drain from feed material and thereby make it possible for the apparatus to handle semi-wet feed material without loss of particle size reduction. Water is an issue because it is incompressible and thereby reduces particle size reduction that could otherwise be achieved with a dry feed material. This advantage is particularly relevant to biomass processing where it is hard to reduce moisture below say 20-50% by compression alone, even with porous rolls and piston and chamber compression.

According to the second aspect of the present invention there is provided an apparatus for crushing material that includes at least one pair of crushing rolls adapted for intermittent rotation roll operation and defining a nip therebetween for receiving feed material and crushing the feed material to a first particle size range and for forcing crushed material from the nip.

The term "pair of crushing rolls" is understood herein to include arrangements in which the rolls in the pair of rolls that define a nip therebetween are backed up by back-up rolls.

Preferably the apparatus is adapted for intermittent rotation in the form of stepped rotation of the crushing rolls.

The above-described apparatus may include any suitable means for operating the pair of rolls on a stepped rotation basis.

One such suitable means is a stepping motor system.

The present invention extends to other systems including mechanical systems.

In use the resultant crushed material from the above-described pair of rolls may be conveyed to a remote location for stockpiling and/or further processing the material or directly fed into a processing plant or otherwise handled as required in a given situation.

The above-described apparatus may include a downstream pair of crushing rolls having a nip therebetween for receiving crushed material from the above-described, hereinafter referred to as "upstream", pair of rolls and crushing the feed material further to a second particle size range, and a transfer chute extending between the upstream and downstream pairs of rolls, whereby in use of the apparatus, crushed material from the upstream pair of rolls forms a feed of material for the downstream pair of rolls as it moves through the transfer chute towards the downstream pair of rolls.

Preferably the apparatus is adapted to form a pressurised feed of crushed material moving through the transfer chute from the upstream pair of rolls to the downstream pair of rolls.

The present invention is not confined to forming a pressurised feed and the feed may be a non-pressurised gravity feed.

The downstream pair of rolls may also be adapted for intermittent, such as stepped, rotation roll operation.

The apparatus may include any suitable means for driving the downstream pair of rolls. By way of examples, the means may be a stepping motor system or a mechanical system.

In use, the resultant crushed material from the downstream pair of rolls may be conveyed to a remote location for stockpiling and/or further processing the material or directly fed into a processing plant or otherwise handled as required in a given situation.

Preferably the feed of material for the downstream pair of rolls is in the form of a moving packed bed of material in the transfer chute.

Preferably the apparatus is arranged so that, in use of the apparatus, the downstream pair of rolls is choke fed from the upstream pair of rolls.

The apparatus may include more than two pairs of rolls, with each pair of rolls successively crushing the material.

Where there are only two pairs of rolls, preferably the downstream pair of rolls is adapted to produce crushed material that has a particle size range that can be conveyed by gas or liquid in a pipeline.

Where there are more than two pairs of rolls, preferably the most downstream pair of rolls is adapted to produce crushed material that has a particle size range that can be conveyed by gas or liquid in a pipeline to another location for stockpiling and/or further processing the material.

The rolls of the upstream and downstream pairs of rolls may be any suitable size and form and be made form any suitable materials, including wear resistant materials.

In terms of form, the rolls may have a smooth surface or may have raised sections, such as studs, to improve wear resistance.

In the case of an underground metalliferous mine, typically the top size of the feed material for the upstream pair of rolls is of the order of 90 mm for smooth rolls (but could be larger) and of the order of 60 mm for studded rolls (but could be larger), the crushed material produced in the upstream pair of rolls is 5-10 mm, and the crushed material produced in the downstream or the most downstream pair of rolls is less than 2 mm.

The apparatus may include a pre-crushing means, such as jaw or gyratory crushers, for pre-crushing feed material to form the feed material for the upstream pair of crushing rolls.

Preferably the apparatus further includes a means for exposing feed material to microwave energy for physically and/or chemically altering the material prior to supplying the feed material to the pair of rolls in situations where there is one pair of rolls only or to the upstream pair of rolls in situations where there are two or more pairs of rolls.

Preferably the apparatus further includes a means for exposing crushed material flowing between upstream and downstream pairs of rolls to microwave energy for physically and/or chemically altering the crushed material.

Preferably the upstream pair of rolls produces crushed material that is in a form that is suitable for microwave energy treatment of the material. For example, preferably the upstream rolls produce a uniform stream of crushed material that is well suited to microwave treatment. By way of further example, preferably the upstream rolls produce a defined geometry of crushed material that is well suited to microwave treatment.

The term "microwave energy" is understood herein to mean electromagnetic radiation that has frequencies in the range of 0.3-300 GHz.

Preferably the microwave energy exposure means is adapted to cause micro-cracking of crushed material that facilitates subsequent breakdown of crushed material in the downstream rolls.

Preferably the microwave energy exposure means is adapted to expose the crushed material to pulsed high energy microwave energy.

The term "high energy" is understood herein to mean values substantially above those within conventional household microwaves, ie substantially above 1 kW.

Preferably the energy of the microwaves is at least 20 kW.

More preferably the energy of the microwaves is at least 50 kW.

The use of pulsed microwave energy minimises the power requirements of the method and maximises thermal cycling of the ore particles.

The time period of the pulses and the time period between pulses of microwave energy may be set as required depending on a number of factors.

According to the present invention there is also provided an apparatus for crushing material and thereafter transporting the crushed material to another location which includes the above-described crushing apparatus and a conveying means for conveying the crushed material (a) from the pair of rolls to another location in situations where there is one pair of rolls only, (b) from the downstream pair of rolls to another location in situations where there are only two pairs of crushing rolls or (c) from the most downstream pair of rolls to another location in situations where there are more than two pairs of rolls.

Preferably the crushing apparatus includes a means for feeding crushed material from the downstream or the most downstream pair of rolls into the conveying means.

The feed means may include a means for accommodating pressure differences between the crushed material produced by the crushing apparatus and the conveying means.

The means for accommodating pressure differences may include one or more than one lock hopper.

Preferably the feed means is adapted to feed crushed material continuously into the conveying means.

Preferably the continuous feed means includes a screw feeder.

Preferably the conveying means includes a pipeline and a means for establishing a flow of gas or liquid through the pipeline for conveying crushed material in the pipeline.

Preferably the conveying means includes a means for separating the crushed material and the conveying gas or liquid at the other location.

Preferably the conveying means includes a means for recycling separated gas or liquid.

According to the present invention there is also provided a method of crushing material that includes steps of supplying a feed material to a nip between an upstream pair of crushing rolls and crushing the feed material to a first particle size range and producing a feed of crushed material and supplying the feed to a nip between a downstream pair of crushing rolls and crushing the feed material to a second particle size range.

Preferably the method includes producing a pressurised feed of crushed material in the upstream pair of crushing rolls.

The method may include crushing the feed material successively in more than two pairs of crushing rolls.

Preferably the method further includes a step of supplying the crushed material from the downstream pair of rolls into a pipeline and conveying the material through the pipeline to another location for stockpiling and/or further processing the material.

According to the present invention there is also provided a method of crushing material that includes the steps of supplying a feed material to a nip between a pair of crushing rolls rotating intermittently, such as in a series of steps, and crushing the feed material to a first particle size range and producing a feed of crushed material.

Preferably the method includes producing a pressurised feed of crushed material.

The method may also include supplying the feed from the above-described pair of rolls, ie an upstream pair of rolls, to a nip between a downstream pair of crushing rolls and crushing the feed material to a second particle size range.

The method may also include crushing the feed material successively in more than two pairs of crushing rolls.

Preferably the method further includes a step of supplying the crushed material from the (a) single roll pair in situations where there is one pair of rolls only, (b) the downstream roll pair in situations where there are two roll pairs only or (c) the most downstream pair of rolls in situations where there are more than two roll pairs, into a pipeline and conveying the material through the pipeline to another location for stockpiling and/or further processing the material.

The present invention is described further with reference to the accompanying drawing which is a schematic representation of one embodiment of an apparatus for crushing material and thereafter conveying transporting the crushed material to another location in accordance with the present invention.

With reference to the drawing, feed material that is mined, for example, in an underground metalliferous mine, and pre-crushed in a pre-crushing means (not shown), such as jaw or gyratory crushers, to a top size of the order of 90 mm is supplied to a upstream pair of crushing rolls 3, each of which has a smooth surface, and is crushed to a first particle size range, typically 5-10 mm, by the rolls.

The upstream pair of crushing rolls 3 is connected to a stepping motor (not shown) that drives the rolls so that the rolls rotate intermittently, more particularly in a series of steps. The stepped rotation of the rolls facilitates gas and moisture removal from the feed material and consequently improves roll performance and feed material throughput.

The crushed material flows downwardly from the upstream pair of rolls 3 in a transfer chute 5 to a downstream pair of crushing rolls 7 and is crushed further by these rolls, typically to a particle size of less than 2 mm.

Suitable seals (not shown) are provided between the transfer chute 5 and the upstream roll pair 3 on the one hand and between the transfer chute 5 and the downstream roll pair 7 on the other hand.

The arrangement and operation of the upstream and downstream roll pairs 3, 7 and the transfer chute 5 is such that the crushed material from the upstream roll pair 3 forms a pressurised feed of material for the downstream roll pair 7. More particularly, the crushed material from the upstream roll pair 3 forms a moving packed bed of crushed material. The pressurised feed for the downstream roll pair 7 facilitates efficient crushing of the material in the downstream roll pair 7.

The crushed material from the downstream roll pair 7 flows downwardly in a transfer chute 13 into a continuous feeder in the form of a screw feeder 9.

The arrangement and operation of the downstream roll pair 7 and the transfer chute 13 is such that the crushed material from the downstream roll pair 7 forms a pressurised feed for the screw feeder 9.

Suitable seals (not shown) are provided between the transfer chute 13 and the downstream roll pair 7 on the one hand and between the transfer chute 13 and the screw feeder 9 on the other hand to accommodate pressure differences between the different sections of the apparatus and, in particular, to prevent flow of material from the pipeline into the screw feeder 9 and from the screw feeder 9 upstream of the screw feeder.

The screw feeder 9 transports the crushed material to a pipeline 11. A suitable gas or liquid, typically water, conveys the crushed material in the pipeline 11 to a remote location for stockpiling and/or further processing. The further processing may include separating the crushed material form the conveying gas or liquid.

The rolls of the upstream and downstream roll pairs 3, 7 may be any suitable rolls for crushing the mined material.

The above-described apparatus also includes a microwave generator 15 that emits pulsed high energy microwave energy through the crushed material flowing through the transfer chute 5 and causes micro-cracking of the material that facilitates subsequent breakdown of the material in the downstream roll pair 7.

The upstream roll pair 3 produces crushed material that is in a form that is suitable for microwave energy treatment of the material. Specifically, the upstream roll pair 3 produces a uniform stream of crushed material that is well suited to microwave treatment. In addition, the upstream roll pair 3 produces a defined geometry of crushed material that is well suited to microwave treatment.

The above-described apparatus is compact and can be positioned in working environments, such as underground mines, which have space constraints, and can efficiently crush mined material to a size that can be conveyed in a pipeline to another location.

Many modifications may be made to the embodiment of the present invention described above without departing from the spirit and scope of the invention.

For example, whilst the embodiment includes two roll pairs, with the upstream roll pair 3 operating on a stepped basis, the present invention is not so limited and extends to single roll pair operation and to more than two roll pair operation operating on a stepped, or any other suitable intermittent rotation, basis.

In addition, whilst the embodiment is described in the context of the use of a stepping motor, the present invention is not so limited and extends to any means for causing intermittent operation of the upstream roll pair 3.

In addition, whilst the embodiment is described in the context of operating the upstream roll pair 3 on a stepped basis, the present invention is not so limited and extends to operating the upstream roll pair on a continuous basis.

In addition, whilst the embodiment is described in the context of crushing mined material, the present invention is not so limited and extends to any suitable application in which it is necessary to crush material. As is indicated specifically above, by way of example, one such other material is biomass material.

In addition, whilst the embodiment is described in the context of mined material obtained by underground mining of metalliferous material, the present invention is not so limited and extends to any suitable application in which it is necessary to crush mined material.

In addition, whilst the embodiment includes conveying the crushed material from the downstream roll pair 7 in the pipeline 11 to a remote location for stockpiling and/or further processing, the present invention is not so limited and extends to any suitable downstream processing of the crushed material. For example, the crushed material may be fed directly into a processing plant.

In addition, whilst the embodiment includes forming a pressurised feed of material in the upstream roll pair 3, the present invention is not so limited and extends to forming a non-pressurised feed in the transfer chute 5. For example, the feed of crushed material from the upstream roll pair 3 may move by gravity feed in the chute 5 to the downstream roll pair 7.

In addition, whilst the embodiment includes transporting crushed material in a pipeline 11 from the screw feeder 9 to the downstream stockpile or for further processing, the present invention is not so limited and extends to any suitable means for transporting crushed material from one location to another location.

The invention claimed is:

1. An apparatus for crushing material comprising:

an upstream pair of crushing rolls intermittently rotating and defining a nip therebetween for receiving feed material and crushing the feed material to a first particle size range and for forcing crushed material from the nip;

a downstream pair of crushing rolls having a nip therebetween for receiving crushed material from the upstream pair of rolls and crushing the feed material further to a second particle size range;

a transfer chute extending between the upstream and downstream pairs of rolls and confining crushed material from the upstream pair of rolls to move to the downstream pair of rolls as a packed bed of material, wherein, in use of the apparatus, crushed material from the upstream pair of rolls forms the packed bed of material as it moves through the transfer chute to the downstream pair of rolls and forms a feed for the downstream pair of rolls; and means for exposing crushed material flowing between upstream and downstream pairs of rolls to microwave energy for physically and/or chemically altering the crushed material.

2. The apparatus defined in claim 1, adapted to form a pressurised feed of material moving through the transfer chute from the upstream pair of rolls to the downstream pair of rolls.

3. The apparatus defined in claim 1, wherein the downstream pair of rolls is also adapted for intermittent rotation roll operation.

4. The apparatus defined in claim 1, wherein, in use of the apparatus, the downstream pair of rolls is choke fed from the upstream pair of rolls.

5. The apparatus defined in claim 1, which includes more than two pairs of rolls, with each pair of rolls successively crushing the material.

6. The apparatus defined in claim 1, wherein, in the case of an underground metalliferous mine, the top size of the feed material for the upstream pair of rolls is of the order of 90 mm for smooth rolls and of the order of 60 mm for studded rolls, the crushed material produced in the upstream pair of rolls is 5-10 mm, and the crushed material produced in the downstream or the most downstream pair of rolls is less than 2 mm.

7. The apparatus defined in claim 1, which includes a pre-crushing means for pre-crushing feed material to form the feed material to the upstream pair of rolls.

8. The apparatus defined in claim 1, which includes a means for exposing feed material to microwave energy for physically and/or chemically altering the material prior to supplying the feed material to the upstream pair of rolls.

9. An apparatus for crushing material and thereafter transporting the crushed material to another location which includes the crushing apparatus defined in claim 1 and a conveying means for conveying the crushed material from the downstream pair of rolls to another location in situations where there are only two pairs of crushing rolls or from the most downstream pair of rolls to another location in situations where there are more than two pairs of rolls.

10. The apparatus defined in claim 9, wherein the crushing apparatus includes a means for feeding crushed material from the downstream or the most downstream pair of rolls into the conveying means.

11. The apparatus defined in claim 10, wherein the feed means is adapted to feed crushed material continuously into the conveying means.

12. The apparatus defined in claim 11, wherein the continuous feed means includes a screw feeder.

13. The apparatus defined in claim 9, wherein the conveying means includes a pipeline and a means for establishing a flow of gas or liquid through the pipeline for conveying crushed material in the pipeline.

14. The apparatus defined in claim 9, wherein the conveying means includes a means for separating the crushed material and the conveying gas or liquid at the other location.

15. The apparatus defined in claim 1, wherein the upstream pair of rolls is adapted to produce a uniform stream of crushed material that is suited to microwave treatment.

16. The apparatus defined in claim 1, wherein the means for exposing feed material to microwave energy is adapted to emit pulsed high energy microwave energy through crushed material flowing through the transfer chute to facilitate subsequent breakdown of the material in the downstream pair of rolls.

17. A method of crushing material that includes steps of supplying a feed material to a nip between an upstream pair of crushing rolls rotating intermittently and crushing the feed material to a first particle size range and producing a feed of crushed material and supplying the feed to a nip between a downstream pair of crushing rolls and crushing the feed material to a second particle size range, and exposing crushed material flowing between the upstream and downstream pairs of rollers to microwave energy.

18. The method defined in claim 17, which includes producing a pressurised feed of crushed material in the upstream pair of crushing rolls.

19. The method defined in claim 17, which includes crushing the feed material successively in more than two pairs of crushing rolls.

20. The method defined in claim 17, which includes a step of supplying the crushed material from the downstream pair of rolls into a pipeline and conveying the material through the pipeline to another location for stockpiling and/or further processing the material.

21. The method defined in claim 17, which includes exposing feed material to microwave energy for physically and/or chemically altering the material prior to supplying the feed material to the upstream pair of rolls.

22. The method defined in claim 17, which includes producing a uniform stream of crushed material that is suited to microwave treatment flowing between the upstream and the downstream pairs of rolls.

23. The method defined in claim 17, which includes exposing feed material flowing between the upstream and the downstream pairs of rolls to pulsed high energy microwave energy to facilitate subsequent breakdown of the material in the downstream pair of rolls.

* * * * *